US006059118A

United States Patent [19]

Ding et al.

[11] Patent Number: 6,059,118

[45] Date of Patent: May 9, 2000

[54] PROCESS FOR RECOVERING FINE PARTICULATES IN A CENTRIFUGAL FLOTATION CELL WITH ROTATING DRUM

[75] Inventors: Jian Ding, Toronto; Wan-Tai Yen; Alan R. Pindred, both of Kingston, all of Canada

[73] Assignee: Inter-Citic Mineral Technologies, Inc., Canada

[21] Appl. No.: 09/290,367

[22] Filed: Apr. 12, 1999

Related U.S. Application Data

[62] Division of application No. 08/871,516, Jun. 9, 1997, Pat. No. 5,928,125.

[51] Int. Cl.[7] ..... B03D 1/02

[52] U.S. Cl. ..... 209/164; 210/703; 494/37

[58] Field of Search ..... 494/23, 25, 26, 494/37, 43, 56, 60, 62, 63, 76, 77, 85, 900; 210/220, 703, 221.2, 360.1, 377, 704, 380.1; 261/124; 209/164–170

[56] References Cited

U.S. PATENT DOCUMENTS

| | | | |
|---|---|---|---|
| 1,702,443 | 2/1929 | Johnson | 209/170 |
| 3,863,838 | 2/1975 | Pronk | 494/60 |
| 5,535,893 | 7/1996 | Jameson | 209/169 |
| 5,914,034 | 6/1999 | Ding et al. | 209/170 |

FOREIGN PATENT DOCUMENTS

| | | | |
|---|---|---|---|
| 2539772 | 7/1984 | France | 209/170 |
| 3634323 | 4/1988 | Germany | 209/170 |
| 52-36367 | 3/1977 | Japan | 494/60 |

*Primary Examiner*—Charles E. Cooley
*Attorney, Agent, or Firm*—Welsh & Katz, Ltd.; Thomas W. Tolpin

[57] ABSTRACT

A user-friendly centrifugal flotation cell with a rotating drum, is provided for use in an efficient separation process to rapidly recover greater quantities of valuable fine particles. In the process, a slurry of fine particles is injected with air bubbles and moved downwardly through a stationary downfeeder to a centrifuge comprising a rotating flotation cell. The aerated slurry is centrifugally separated into a waste stream of non-floating gangue material and a particulate-enriched froth comprising air bubbles carrying a substantial amount of the valuable fine particles. The froth is processed by froth flotation in a froth flotation chamber.

4 Claims, 3 Drawing Sheets

28
24
22
14
26
18
49
20
10
48
16
44
42
62
46
46
40
58
36
38
60
52
54
50

PROCESS FOR RECOVERING FINE PARTICULATES IN A CENTRIFUGAL FLOTATION CELL WITH ROTATING DRUM

This is a division of application Ser. No. 08/871,516, filed Jun. 9, 1997, now U.S. Pat. No. 5,928,125.

BACKGROUND OF THE INVENTION

This invention pertains to separating fine particles from ore minerals, mine tailings and the like and, more particularly, to recovering valuable fine particles of minerals and metals by centrifuging and froth flotation.

Centrifuges and centrifugal separators are commonly used to separate fluid mixtures by centrifugal force into higher density and lower density fractions in order to separate one material from another material. Conventional centrifuges and centrifugal separators have met with varying degrees of success depending on the materials being separated. Many conventional centrifuges, however, are expensive, have high operational energy requirements, create excessive turbulence, cause high pressure discharges, and can require complex auxiliary equipment, such as slurry accelerators.

Another type of separating process is froth flotation. In conventional (traditional) froth flotation, an input stream, such as a mineral slurry, is combined and commingled with an airstream. Conventional froth flotation separates materials primarily by the attachment of air bubbles and particles. Air bubbles attach with hydrophobic material from the input stream float to the surface as a froth, while hydrophillic material unable to attach with bubbles sink to the bottom. The froth is skimmed off the surface.

Froth flotation is a known process for the separation of finely ground minerals from slurries or suspensions in a liquid, usually water. The particles desired to remove from the slurry can be treated with chemical reagents to render them hydrophobic or water repellent, and a gas, usually air, is introduced into the slurry in the form of small bubbles. The air bubbles contact with the hydrophobic particles and carry them to the surface of the slurry to form a stabilized froth. The froth containing the floated particles is then removed as the concentrate or float product, while any hydrophilic particles remain submerged in the slurry and then are discharged. Conventional froth flotation has met with varying degrees of success.

Precious metals and valuable minerals are mined from mineral deposits throughout the world for a variety of uses. It is important to maximize recovery of precious metals and valuable minerals during mining operation from an economic standpoint and operate the mine in an environmentally responsible and safe manner. Mining operations produce huge ponds of tailings containing very fine particles (fines) of precious metals and valuable minerals which are generally not recoverable by conventional, traditional froth flotation, and other conventional separating techniques.

Many industries use precious metals and valuable minerals for different purposes. For example, oil refineries and petrochemicals plants use platinum, nickel, antimony, etc. for catalysts to convert oil into fractions which are useful to produce gasoline and other fuels, as well as to produce chemicals for textiles and plastics. Once the catalysts have been used, precious metals can often be recovered or regenerated for further use. Numerous methods have been used in an effort to reclaim precious metals. In reclamation, vast reservoirs of tailings containing fine particles (fines) of precious metals are often produced but the valuable fines are generally unable to be reclaimed by conventional, froth flotation and other conventional separating techniques.

A centrifugal flotation cell has been developed which combines centrifuging and froth flotation to recover a greater amount of valuable fines. While this provides a very useful apparatus and method, it is desirable to provide an improved centrifugal flotation cell and process which are faster, more economical and recover greater quantities of valuable fines, as well as which overcome most, if not all, of the preceding problems.

SUMMARY OF THE INVENTION

An improved centrifugal flotation cell and process are provided to more readily recover a greater quantity valuable fine particles, such as particulates of gold, platinum, silver, nickel, sulphides and other metals, ores, trace elements, minerals, papers, fibers and oher fibrous or vegetable matters, and oil. Significantly, the novel centrifugal flotation cell and process are efficient, economical and effective and are able to recover very small valuable fine particles in tailings which most prior systems and processes are unable to reclaim. The user-friendly centrifugal flotation cell and process utilize a combination of centrifugal forces and froth flotation to rapidly recover minute particulates. Advantageously, the centrifugal flotation cell and process are easy to use, reliable, attractive, and provide a greater throughput and recovery than conventional separation equipment and methods.

In the novel centrifugal flotation process, air bubbles are injected into a slurry of fine particles, such as by air injectors, an aerator or preferably a sparger, to sparge and aerate the slurry. The slurry and air bubbles are directed downwardly preferably together, through a downfeeder into a centrifuge of a separation apparatus, preferably comprising the centrifugal flotation cell. The slurry and air bubbles are rotated and centrifuged to separate the slurry into a waste stream comprising non-floating gangue material, which is discharged and removed, and a particulate-enriched froth comprising air bubbles carrying and containing a substantial portion of the valuable particulates sought to be recovered. The particulate-enriched froth is removed and recovered by froth flotation. In the preferred process, the particulate-enriched froth is directly radially inwardly before rising to the surface and traveling radially outwardly over an overflow wier into a discharge chute and froth launder.

The novel centrifugal flotation cell has a stationary downfeeder and a rotatable centrifuge providing a rotating flotation cell, preferably comprising a rotating drum. The bottom of the centrifuge is positioned below the downfeeder. A power driven shaft can extend through the downfeeder. The shaft can be operatively connected to the bottom of the centrifuge and driven by a motor to rotate the centrifuge. In one embodiment, the centrifuge has a substantially flat or planar bottom with flared sidewalls. In another embodiment, the centrifuge comprises a bowl with a concave bottom and curved sidewalls.

A froth flotation chamber is positioned between the downfeeder and the sidewalls of the centrifuge. The flotation chamber can have one or more upright walls which provide a wier that extends to a height above the centrifuge. A discharge chute can be connected to the wier above the centrifuge to discharge the froth.

The centrifugal flotation cell can also have a housing with upright housing walls which are positioned externally about the centrifuge, downfeeder, and flotation chamber. The housing can have an inclined floor and an outlet, which are positioned at a level below the centrifuge to facilitate discharge of the waste stream comprising the non-flotating gangue material. Preferably, the gangue material passes upwardly through an annular passageway in the space between the flotation chamber and the centrifuge, before traveling downwardly in a gangue-receiving passageway between the centrifuge and the housing walls. A containment plate can extend between and connect the flotation chamber to the housing walls at a location between the centrifuge and chute.

In the illustrative embodiment, a slurry feed line communicates with the downfeeder to pass slurry to the downfeeder and a sparger is positioned in the slurry line to inject air bubbles in the slurry. The slurry can flow in upward direction, outside of the apparatus, before being injected with air bubbles. The slurry and air bubbles can also flow concurrently in a horizontal direction before being directed downwardly into the centrifuge. In some circumstances, it may be desirable that the slurry and air bubbles are fed into the downfeeder or centrifuge by separate lines.

A more detailed explanation of the invention is provided in the following description and appended claims taken in conjunction with the accompanying drawings.

DETAILED DESCRIPTION OF THE PREFERRED EMBODIMENTS

Figure 1:
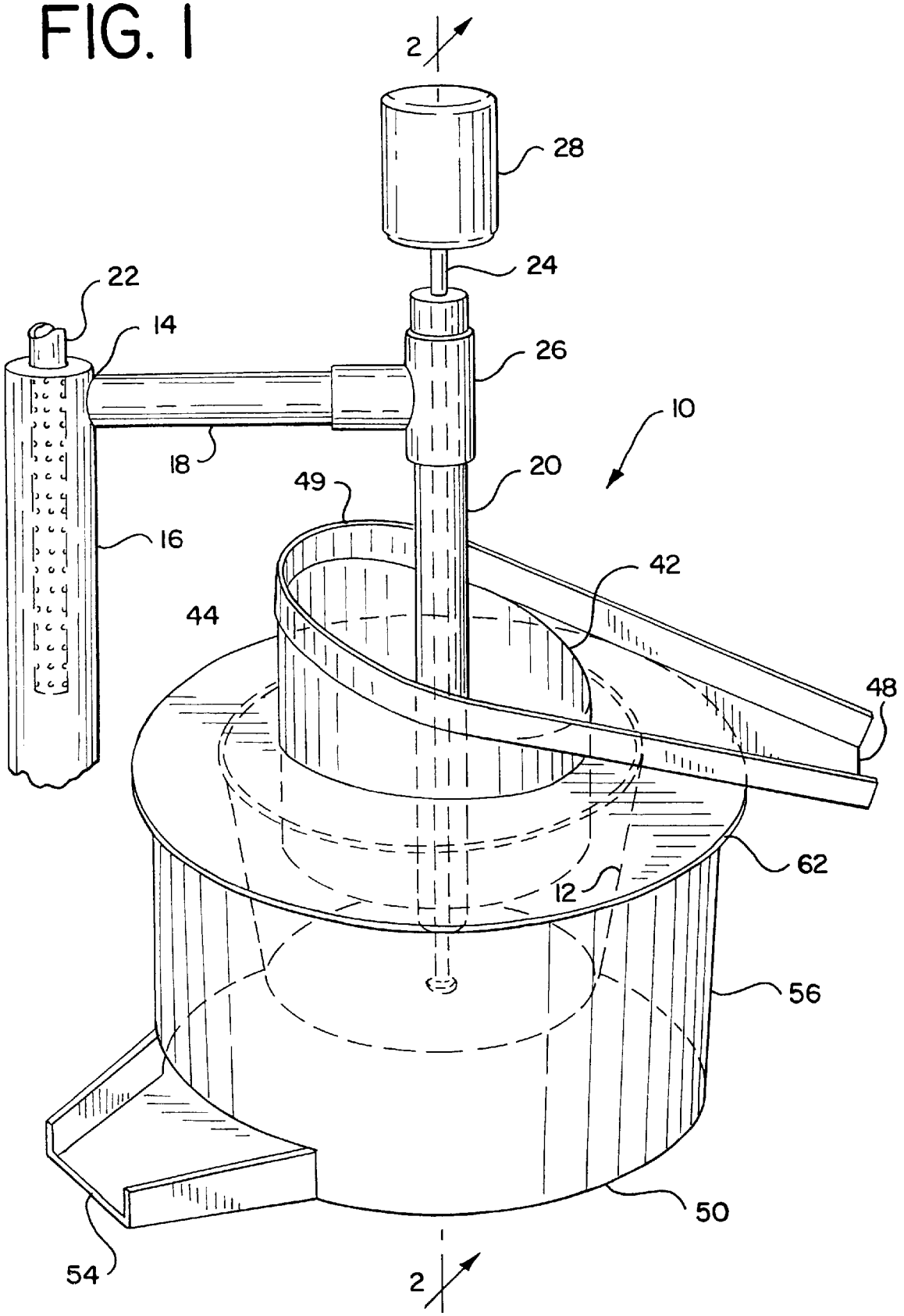
FIG. 1 is a fragmentary perspective view of a centrifugal flotation cell with a rotating drum in accordance with principles of the present invention.

A centrifugal flotation cell 10 (FIGS. 1 and 2) with a rotating (rotatable) drum 12 provides an apparatus and separator equipment to recover fine particles (fines) comprising particulates of minerals, metal, ore, etc. The centrifugal flotation cell, which is also referred to as a "CFC" or "CFC-Q1", can have a slurry line 14, comprising one or more sections of pipe, conduits or tubes. The slurry line can comprise a slurry feed line with a vertical sparger section 16 and a transverse section 18. The transverse section can extend horizontally between and connect and communicate with the vertical sparger section and an upright stationary downfeeder 20. The slurry feed line feeds and passes a slurry (slurry feed) containing the fine particles sought to be recovered, to the downfeeder. A sparger 22, which provides an air-injector and aerator, can be positioned in the vertical sparger section of the slurry line to inject air bubbles into the slurry and aerate the slurry. The air bubbles and aerated slurry can be pumped through the slurry feed line to the downfeeder. The downfeeder, which is also referred to as a downcomer, can comprise a fixed, non-moveable vertical pipe, conduit or tube.

An elongated shaft 24 can extend vertically through the downfeeder along the vertical axis of the downfeeder. The shaft can also extend vertical through a bearing housing and collar 26 mounted above portions of the downfeeder. The upper end of the shaft is connected to a motor 28, such as a variable speed motor. The lower end of the shaft is fastened or otherwise securely connected and concentrically attached to the bottom 30 (FIG. 2) of the rotating drum. The motor drives and rotates the shaft and drum.

Figure 2:
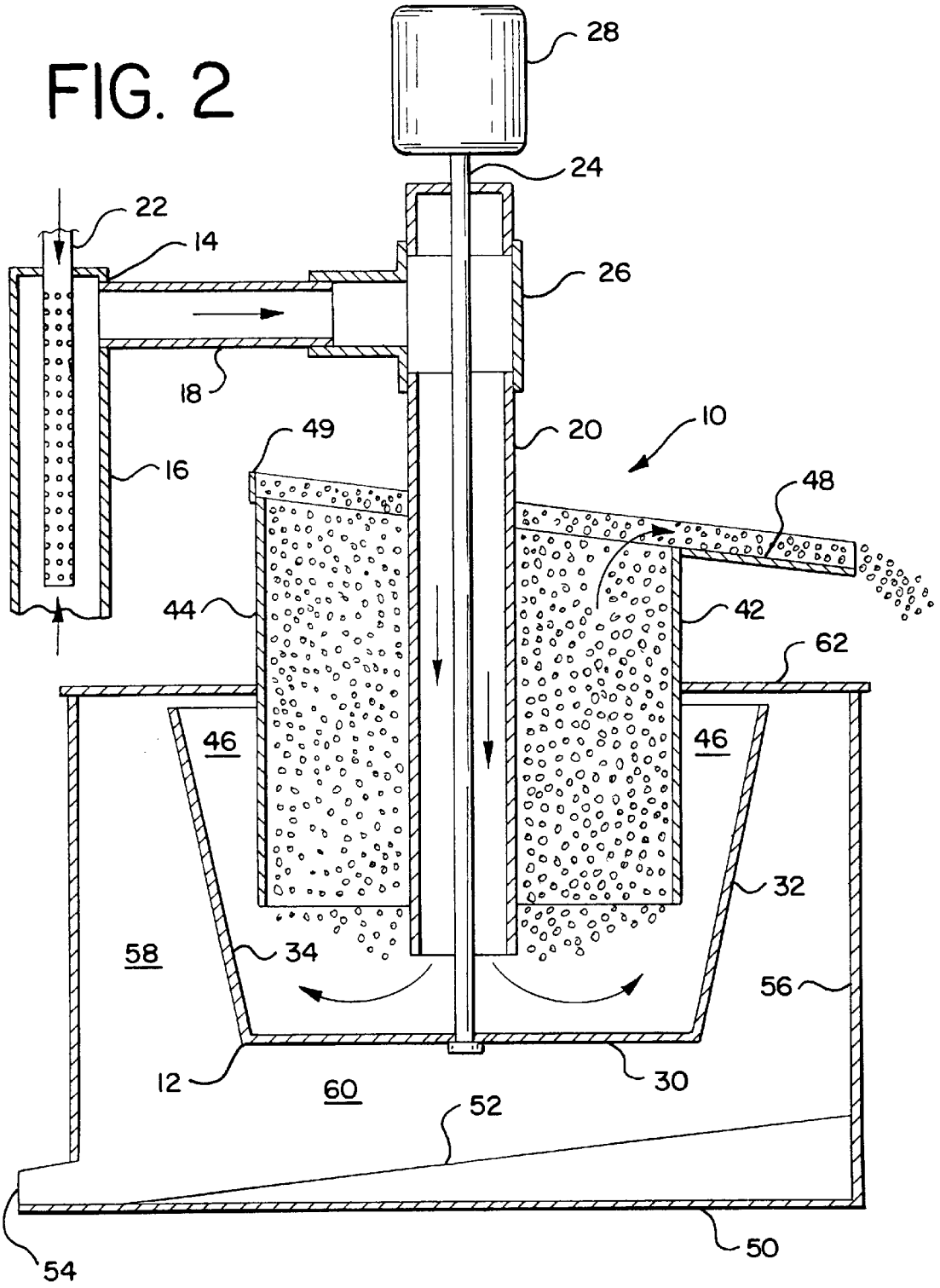
FIG. 2 is a cross-sectional view of the centrifugal flotation cell taken substantially along line 2–2 of FIG. 1.
Figure 3:
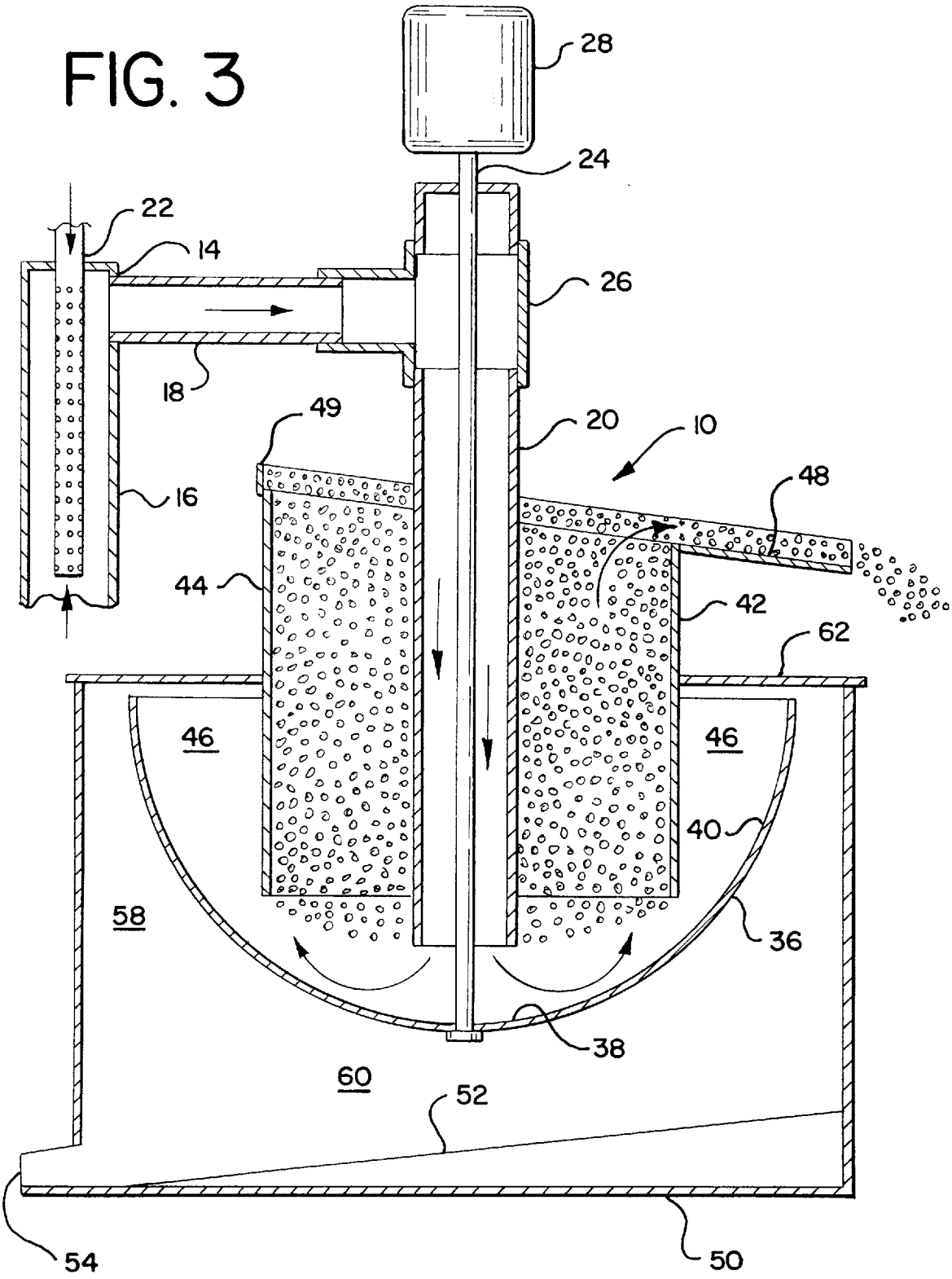
FIG. 3 is a cross-sectional view similar to FIG. 2, but with a centrifugal flotation cell with a rotating drum comprising a bowl in accordance with principles of the present invention.

The rotating drum provides a centrifuge which preferably comprises a rotating flotation cell to separate the slurry into a waste stream of non-floating gangue material and a particulate-enriched froth comprising air bubbles carrying a substantial portion of the particulates. The rotating flotation cell is aligned concentrically in registration with the downfeeder. The rotating flotation cell can have outwardly flared sidewalls 32 (FIG. 2), which can extend and diverge upwardly and outwardly from the bottom. The inner surface of the flared sidewalls can provide an impingement surface 34 to deflect and guide the waste stream upwardly and outwardly. The bottom of the rotating flotation cell of FIG. 2 can be substantially planar and flat and is spaced below the bottom of the downfeeder. The rotating flotation cell (drum) can also comprise a bowl 36 (FIG. 3) with a concave bottom 38 and curved rounded sidewalls 40.

Positioned between the downfeeder and the sidewalls of the rotating flotation cell. is a flotation chamber 42 with an upright annular wall 44. The upright annular wall provides a vertical wier which extends to a height above the flared sidewalls of the rotating flotation cell. The wier is spaced away from and cooperates with the flared sidewalls of the rotation flotation cell to provide an annular passageway 46 therebetween for upward passage of the waste stream containing the gangue material. A froth launder comprising an inclined discharge chute 48 is connected to the top of the wier. The chute extends outwardly and downwardly from the wier at a height spaced above the flared sidewalls of the rotating flotation cell (drum) to discharge the particle-enriched froth comprising air bubbles carrying entrained particulates. A top rail 49, which provides a flange, can be positioned along the top of the chute and wier.

A housing 50 provides an exterior shell and shroud with an inclined floor 52 (FIGS. 2 and 3) which extends downwardly to a waste outlet 54, which can comprise a waste discharge chute. The floor and outlet are positioned at a level below the bottom of the rotating flotation cell (drum) to discharge the waste stream comprising the gangue material. The housing (shroud) has upright vertical housing walls 56 which are positioned concentrically about and are spaced outwardly from the flared sidewalls of the rotating flotation cell to provide an annular gangue-receiving chamber 58 therebetween. The gangue-receiving chamber is fluidly positioned between and communicates with the annular passageway and the passageway 60 spaced between the housing floor and the bottom of the rotating flotation cell (drum).

An annular containment plate 62 can extend horizontally between and connect the wier to the upright housing walls. In the illustrative embodiment, the containment plate is disposed at a location between the launder (chute) and the sidewalls of the rotating flotation cell (drum). The containment plate provides a barrier which helps contain the waste stream in the annular chamber and gangue-receiving chamber.

In use, a conditioned feed slurry is pumped, introduced and fed into the slurry feed line where it is injected and aerated with air bubbles from the sparger. The slurry and air bubbles then flow horizontally through the transverse section of the slurry feed line and downwardly through the downfeeder comprising a vertical pipe into the bottom of the centrifuge comprising the rotating flotation cell (rotating drum). The rotating flotation cell spins and rotates the slurry and air bubbles with sufficient centrifugal force to separate the slurry into: (1) a waste stream of gangue material comprising slurry waste with unfloated particles; and (2) a particulate-enriched froth comprising air bubbles carrying the bulk of the fine particulates sought to be recovered. The waste stream is driven radially outwardly by centrifugal force towards the flared sidewalls of the rotating flotation cell. The waste stream flows upwardly in the annular passageway along and over the flared sidewalls and downwardly in the annular gangue-receiving chamber between the flared sidewalls and housing walls. The waste stream moves by gravity flow along the inclined floor of the housing and is discharged and exits, the centrifugal flotation cell through the waste outlet.

The particle-enriched froth containing air bubbles with attatched fine particles moves radially inwardly towards the downfeeder and rises to and floats at the surface. The froth then flows radially outwardly and over the top of the overflow wier and down the launder comprising the inclined chute where it is discharged and sent as concentrate for further processing.

The centrifugal flotation cell can be used to recover sulfides and non-sulfides minerals, metals and trace elements with coarse and very fine grinding. The centrifugal flotation cell is especially useful to recover valuable fine particles, such as, chalcopyrite ($CuFeS_2$), galena (PbS), sphalerite (ZnS), pentlandite ((FeNi)S), molybdenite ($MoS_2$), gold (Au), phosphate ($P_2O_5$), and coal, as well as valuable fine particulates from porphyry, copper-gold ore, sulfide copper-lead-zinc ore, sulfide nickel ore and other ores. The centrifugal flotation cell can also be used to separate and recover oil, petroleum, petrochemicals and other hydrocarbons from water and other liquids, as well as to separate slurries and liquids contaminated with fine particles in waste treatment facilities, waste water cleanup and treatment.

The slurry feed rate in the centrifugal flotation cell with the rotating drum can range from 1–5 liters per minute. The air flow rate from the sparger can be from 2–10 liters per minute. The rotating flotation cell (drum) comprising the centrifuge and shaft can rotate at a speed of 100–400 rpm. In some circumstances, it may be desirable to use other combinations of slurry feed rates, air flow rates, and rotational speeds.

Advantageously, the centrifugal flotation cell can quickly recover 98% of fine valuable particles including most fine particles less than 50 microns and many fine particles as small as 2–10 microns.

EXAMPLES 1–3

The centrifugal flotation cell with a rotating drum, of the type shown in FIG. 1, was operated at different rotating speeds (rotational speeds), with an air flow rate of 6 liters per minute, and a grind time of 10 minutes to recover lead minerals. The grade of lead minerals in the particulate-enriched froth and in the waste stream (tailings) of gangue material are indicated in Table 1, hereinafter, as is the percentage of lead minerals recovered.

TABLE 1

Test Results
Effect of Cell Rotating Speed

| Test No. | Rotating Speed-RPM | Grade, % Lead Froth | Grade, % Lead Gangue | % Recovery |
|---|---|---|---|---|
| 1 | 100 | 59.47 | 0.7 | 80.78 |
| 2 | 200 | 83.62 | 0.7 | 84.7 |
| 3 | 150 | 62.06 | 0.31 | 92.57 |

Air Flowrate: 6 LPM
Grind: 10 minutes.

It is evident from the tests in Examples 1–3 that the optimum speed to attain the highest recovery of lead minerals is 150 rpm, while the speed to attain the highest concentration grade of lead minerals in the froth is 200 rpm.

EXAMPLES 3–5

The centrifugal flotation cell of Examples 1–3 were operated at a rotating speed of 150 rpm and an air flow rate of 6 liters per minute, but with different grinding times as indicated in Table 2 below. The grade of lead minerals in the particulate-enriched froth and in the waste stream (tailings) of gangue material are shown in Table 2 below, as is the percentage of lead minerals recovered.

TABLE 2

Effect of Grind

| Test No. | Grind Time Minutes | Grade, % Lead Froth | Grade, % Lead Gangue | % Recovery |
|---|---|---|---|---|
| 3 | 10 | 62.06 | 0.31 | 92.57 |
| 4 | 20 | 63.97 | 0.65 | 85.01 |
| 5 | 30 | 39.02 | 0.93 | 80.41 |

It is apparent from the tests that optimum grinding time to achieve the highest percentage recover of lead minerals is 10 minutes, but a grinding time of 20 minutes achieved a higher grade of lead minerals in the froth. In these tests, 92% of the lead particulates (fines) recovered were of a size less than 20 microns while 14% of the lead particulates (fines) recovered were smaller than 14 microns.

The centrifugal flotation cell with the rotating drum is useful to separate and recover sulphide (sulfide) minerals, non-sulphide (non-sulfide) minerals and precious metals, as well as other metals, ores and fine particles. Among the many types of sulphide minerals that can be separated and recovered by the inventive centrifugal flotation cell with a rotating drum are: arsenopyrite, bornite, chalcocite, chalcopyrite, cobaltite, covellite, galena, marcasite, molybdenite, pentlandite, polydymite, pyrite, pyrrhotite, sphalerite, stibnite, tetrahedrite, and vaesite. Among the many types of non-sulphide minerals that can be separated and recovered by the inventive centrifugal flotation cell with the rotating drum are: anglesite, apatite, azurite, cassiterite, cerussite, chromite, coal, cuprite, fluorite, garnet, graphite, iron-oxides, malachite, monozite, potash, pyrolusite, rare earths, rutile, scheelite, smithsonite, talc, wolframite, zincite, and zircon. Among the many types of precious metals that can be separated and recovered by the inventive centrifugal flotation cell with the rotating drum are gold, silver, and platinum. Other types of sulphide minerals, non-sulfide minerals, and precious metals can be separated and recovered by centrifugal flotation cell with the rotating drum of this invention.

| Among the many advantages of the centrifugal flotation cell and process are: |
|---|
| 1. Superior reclaimation of fine particles of minerals, metals, trace elements, and other materials. |
| 2. Outstanding ability to recovery fine mineral particles which are unrecoverable with most conventional processes. |
| 3. Enhanced recovery of valuable fines. |
| 4. Greater recovery of small particulates. |
| 5. Better centrifugal separation and flotation. |
| 6. Faster flotation rate. |
| 7. Greater concentration and recovery of fine particles. |
| 8. Simple to operate. |
| 9. Greater throughput. |
| 10. Convenient. |
| 11. Dependable. |
| 12. User-friendly. |
| 13. Economical. |
| 14. Efficient. |
| 15. Effective. |
| 16. A smaller unit volume required as compared with the conventional flotation cell. |
| 17. Energy saving. |
| 18. Low power cost. |

Although embodiments of this invention have been shown and described, it is to be understood that various modifications and substitutions, as well as rearrangements, of parts, components, equipment and process steps, can be made by those skilled in the art without departing from the novel spirit and scope of the invention.

What is claimed is:

1. A process for recovering fine particles, comprising the steps of:

forming an aerated slurry by injecting air bubbles into a slurry of fine particles comprising particulates selected from the group consisting of minerals, metal, ore, and oil;

feeding said aerated slurry of fine particles and gaseous bubbles in a downward direction into a stationary downfeeder;

rotating and separating said aerated slurry in a centrifuge into a waste stream comprising non-floating, gangue material and a particulate-enriched froth comprising gaseous bubbles carrying a substantial portion of said particulates, said centrifuge having a bottom positioned below said downfeeder and a sidewall extending upwardly and outwardly from said bottom;

floating said particulate-enriched froth in a flotation chamber positioned between said downfeeder and said sidewall of said centrifuge, said flotation chamber having an upright wall providing a wier extending to a height above said sidewall of said centrifuge;

discharging said froth from said flotation chamber via a discharge chute connected to said weir and spaced above said sidewall of said centrifuge;

passing said waste stream comprising said non-floating gangue material through an annular passageway between said sidewall of said centrifuge and said flotation chamber and then through a gangue-receiving chamber between an upright housing wall of a housing and said sidewall of said centrifuge;

discharging said waste stream comprising said non-floating gangue material along an inclined floor and an outlet of said housing, said outlet positioned at a level below said centrifuge; and said centrifuge being rotated by a motor via a shaft extending through said downfeeder and connected to the bottom of said centrifuge.

2. A process in accordance with claim 1, wherein said injecting includes sparging and aerating said slurry with a sparger positioned in a slurry feed line communicating with said downfeeder.

3. A process in accordance with claim 1, wherein said slurry is centrifuged in said centrifuge, and said centrifuge comprises a bowl with a substantially flat bottom and a flared sidewall.

4. A process in accordance with claim 1 wherein said waste stream is contained in said annular passageway and said gangue-receiving chamber by a containment plate extending between and connecting said wier to said housing wall, and said containment plate is disposed between said centrifuge and said chute.

* * * * *